US006356245B2

(12) United States Patent
Metzen et al.

(10) Patent No.: US 6,356,245 B2
(45) **Date of Patent: *Mar. 12, 2002**

(54) MICROWAVE STRIP TRANSMISSION LINES, BEAMFORMING NETWORKS AND ANTENNAS AND METHODS FOR PREPARING THE SAME

(75) Inventors: Phillip Lee Metzen, Foster City; Richmond Douglas Bruno, San Jose, both of CA (US)

(73) Assignee: Space Systems/Loral, Inc., Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/283,501

(22) Filed: Apr. 1, 1999

(51) Int. Cl.[7] ..... H01Q 1/00

(52) U.S. Cl. ..... 343/905; 343/700 MS; 343/906

(58) Field of Search ..... 343/700 MS, 884, 343/906, 905; 361/794

(56) References Cited

U.S. PATENT DOCUMENTS

| | | | | |
|---|---|---|---|---|
| 3,587,110 A | * | 6/1971 | Woodward | 343/814 |
| 3,768,048 A | | 10/1973 | Jones, Jr. et al. | 333/84 M |
| 3,825,861 A | | 7/1974 | O'Donnell | 333/33 |
| 3,880,723 A | | 4/1975 | Lane | 204/12 |
| 4,605,915 A | | 8/1986 | Marshall et al. | 333/238 |
| 5,227,742 A | | 7/1993 | Suzuki | 333/1 |
| 5,483,380 A | * | 1/1996 | Harvey et al. | 342/368 |
| 5,539,415 A | * | 7/1996 | Metzen et al. | 343/700 MS |
| 5,768,109 A | * | 6/1998 | Gulick et al. | 361/794 |
| 5,906,042 A | * | 5/1999 | Lan et al. | 29/852 |

FOREIGN PATENT DOCUMENTS

EP 0800225 A2 3/1997

* cited by examiner

*Primary Examiner*—Don Wong
*Assistant Examiner*—Shih-Chao Chen
(74) *Attorney, Agent, or Firm*—Perman & Green, LLP

(57) ABSTRACT

A novel method for producing improved RF transmission lines for satellite beamforming networks and printed circuit antenna(s) comprising the steps of (1) bonding together (a) a central conductor strip or trace comprising a dielectric layer or circuit board having on one or both surfaces thereof conductive strip circuitry; (b) upper and lower core layers of lightweight closed-cell plastic foam bonded to (a), and (c) upper and lower surface layers or faceskins of conductive metal foil or of dielectric material bonded to metal foil layers inside and/or outside, to form ground planes, bonded to the surfaces of the adjacent foam core layers. The next step involves boring a plurality of holes or vias through the ground plane layers and the core layers, and plating the bores or vias with an electroconductive metal to provide a plurality of electroconductive connections between the ground planes, for parallel plate propagating mode suppression, and to connect independent assemblies by using plated through via interconnects and quarter wavelength overlapping line interconnects to electrically connect numerous central conductor strip along with a two step bonding process, or to form a multilayer package.

22 Claims, 7 Drawing Sheets

MICROWAVE STRIP TRANSMISSION LINES, BEAMFORMING NETWORKS AND ANTENNAS AND METHODS FOR PREPARING THE SAME

BACKGROUND OF THE INVENTION

1. Field of the Invention

The present invention relates to a method for producing radio frequency transmission line beamforming networks and antennas having improved electrical properties and increased strength-to-weight or mass ratios, for use in beamforming networks for satellite antennas.

2. State of the Art

Satellite communications multibeam antennas or phased arrays have been developed to provide precisely tailored beams to cover multiple designated coverage areas on the earth without wasting antenna beam coverage or radiated power on regions where there are no users of interest.

Space-borne antennas were individually designed and assembled for a particular satellite, usually launched for a specific purpose. Each element of the many elements of the antenna had to be individually fabricated and assembled. Thus, the antenna was very expensive to fabricate and assemble.

Commonly-assigned U.S. Pat. No. 5,539,415 discloses an inexpensive, small, compact, light weight, easy to assemble, multibeam or phased array device useful as a direct radiating array or as a feed for a reflector or lens antenna. The device employs an array of planar radiators coupled to radio frequency (R.F.) transmission lines to form individual feed or antenna strips. The feed or antenna strips are coupled into a filter to pass the desired band of frequencies and reject undesirable bands of frequencies. The filters are coupled to Monolithic Microwave Integrated Circuit (MMIC) amplifiers that contain N amplifiers with an integral isolator. Amplifiers are Solid State Power Amplifiers (SSPA's) or Low Noise Amplifiers (LNA's). SSPA's are used for the transmit mode and LNA's are used for the receive mode. Amplifiers are utilized to amplify the aforementioned RF signals.

Previously-known RF strip transmission lines for use in antenna(s), antenna feed(s) and beamforming network(s) of the types disclosed by U.S. Pat. No. 5,539,415 have a wide variety of disadvantages.

A microwave transmission line configuration known as bonded strip transmission line is formed from two solid dielectric substrates with metal foil (usually copper) bonded or plated to one or both flat sides of each substrate. The substrates are bonded together under pressure and at elevated temperature to form a sealed package. The foil is configured (usually by photo etching) to have two metal ground planes with one or more metal strip conductors in the middle to form a strip transmission line. The middle conductor can be formed (usually by photo etching) to produce various microwave circuits. Channelization may be used to prevent unwanted parallel plate modes.

Other previously-known microwave transmission lines are referred to as bar line and suspended air strip transmission lines. They are composed of one or more metal bars or thin dielectric supported strips located midway between two metal ground planes forming a microwave transmission line. The middle bar in bar lines is suspended between the ground planes using low dielectric constant honeycomb or foam. The package for bar line and for suspended air strip transmission lines is held together by mechanically clamping, usually with bolts or screw fasteners.

The previously-known structures for microwave transmission lines of the aforementioned types have important disadvantages with respect to their electrical and/or their physical properties such as strength and weight. The barline and suspended air strip transmission lines are composed of unbonded layers, mechanically fastened together, requiring thicker structural panels and numerous mechanical fasteners to provide a good degree of mechanical performance under sheer and tension forces. The resulting barline and suspended air strip transmission line configurations are heavy and have a high weight to strength ratio. Also, they are composed of individual components: machined ground planes, conducting bars for the barline and photo etched strips for the suspended air strip transmission line, and foam or honeycomb cores mechanically held together with fasteners requiring substantial assembly time and labor intensive methods used to fabricate and assemble the barline and suspended air strip transmission line packages.

Also, the prior known bonded strip transmission line beamforming networks suffer high RF energy insertion loss.

SUMMARY OF THE INVENTION

The present invention provides a novel method for producing improved RF transmission lines for satellite antennas and beamforming networks, comprising the steps of (1)bonding together (a) a central conductor strip or trace strip comprising a dielectric layer or circuit board having on one or both surfaces thereof conductive strip circuitry; (b) upper and lower core layers of lightweight closed-cell plastic foam bonded to (a), and (c) upper and lower surface layers or faceskins of conductive metal foil or of dielectric material bonded to metal foil layers inside and/or outside, or solid metal plates, to form ground planes, bonded to the surfaces of the adjacent foam core layers, (2) boring holes or vias through the ground plane or through the central conductor strips, core layers and ground plane, layers and the core layers, and (3) plating the bores or vias with an electroconductive metal, usually copper, to provide a plurality of electroconductive connections between the ground planes, for parallel plate propagating mode suppression, or between central conductor strips to connect independent assemblies.

THE DRAWINGS

DETAILED DESCRIPTION

Figure 1:
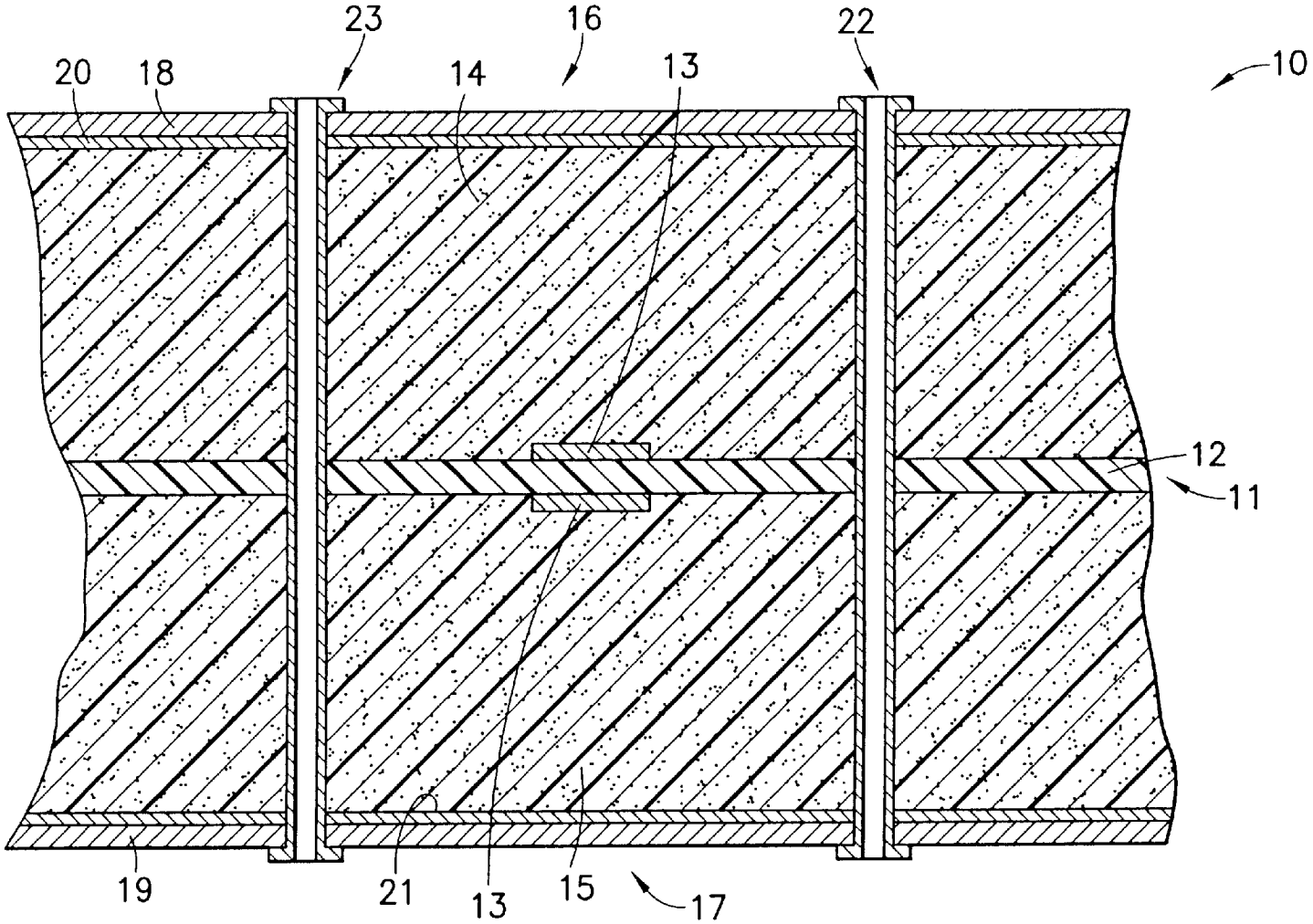
FIG. 1 is a cross-sectional view of a bonded air strip transmission line according to an embodiment of the present invention.

Referring to FIG. 1, the strip transmission line (STL) component 10 thereof is a bonded composite assembly of a center conductor strip 11 comprising a dielectric support 12 having bonded to one or both sides thereof (as shown) narrow elongate metal layers or foils 13. The center strip 11 is bonded between lightweight plastic foam core layers 14 and 15 by means of a resinous adhesive at elevated temperature and pressure, and thin faceskins 16 and 17 are similarly adhesive-bonded to the upper and lower surfaces of the core layers 14 and 15, respectively.

The illustrated faceskins 16 and 17 each comprise a dielectric or metal support 18 or 19 and an inner conductive metal foil 20 or 21 bonded thereto, adjacent the foam core layer 14 or 15. The conductive metal foils 20 and 21 form ground planes on the composite assembly. For parallel plate propagating mode suppression the ground planes are electrically united by conductive connections. Such connections are produced in the present STL assemblies by forming bores 22 or vias through the faceskins 16, 17 and foam core layers 14, 15 and the dielectric support 12 of the center strip 11, and coating or plating the inner walls of the bores 22 with a continuous layer 23 of conductive material such as electroless copper as used in the printed circuit board art. The conductive layer 23 in each bore 22 connects electrically with the conductive metal foil layers 20 and 21 on the opposed faceskins 16 and 17 to produce electrical conductivity between the faceskins for mode suppression.

It should be understood that the faceskins 16 and 17 may have the foil layers 20 and 21 on either the inner or outer surface of the dielectric layer 18 or 19, or on both surfaces. Also it is possible to use conductive metal foil or metal plate, per se, without the need for the dielectric support layer 18 or 19.

The bonded composite assembly of FIG. 1 is integral, strong and lightweight and derives its strength from the fact that the various layers thereof are bonded to one another and cannot slip or slide under sheer and tension forces relative to one another. Also, it is fabricated using high speed, mass production printed circuit board (PCB) techniques including photo-etching, bonding, routing, drilling and plating or via-filling, resulting in a unitary fabricated unit requiring minimum assembly.

For applications requiring low values of radio frequency energy insertion loss the present invention is advantageous for the following reasons:

a. Plastic foam core layers have a much higher content of air than solid dielectric material resulting in a lower dielectric constant with a lower loss tangent, and therefore, a lower radio frequency energy loss in the dielectric material.

b. Due to the lower dielectric constant, the width of the strip conductor will be wider for the same ground plane spacing and characteristic impedance. A wider strip width results in lower radio frequency copper loss and less sensitivity to etching tolerances.

c. Since the foam is physically lighter than the solid dielectric material, the ground plane spacing can be greater for the same weight resulting in a wider strip conductor and, therefore, a lower radio frequency copper loss for the same weight or mass.

For applications requiring high impedance lines this invention is advantageous for the following reason:

a. Due to the lower dielectric constant, the width of the strip conductor will be wider for high impedance characteristic and, therefore, less sensitive to etching tolerances.

For applications requiring low weight or mass, this invention is advantageous for the following reason:

a. The foam core is much lighter than solid dielectric material resulting in a lighter configuration.

For applications requiring high strength to weight or mass ratios, this invention is more advantageous.

It should be noted that the present assemblies are sandwich constructions of face plates and core material, and the strength and stiffness are determined primarily by the thickness of the core material (ground plane spacing). Therefore, the invention is advantageous for the following reasons:

a. The foam core configuration is much lighter for the same thickness than a solid core configuration.

b. The foam core configuration can be made much thicker than the solid core configuration for the same weight resulting in a higher strength to weight or mass ratio.

Figure 2:
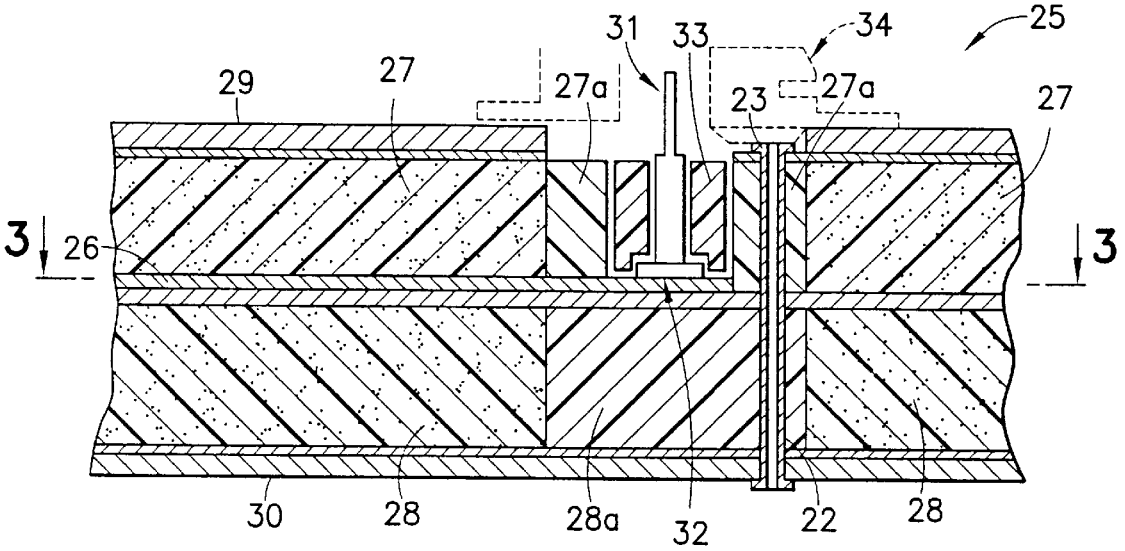
FIG. 2 is a cross-sectional view of a present bonded air strip transmission line assembly implemented with a side launch connector, according to an embodiment of the present invention.
Figure 3:
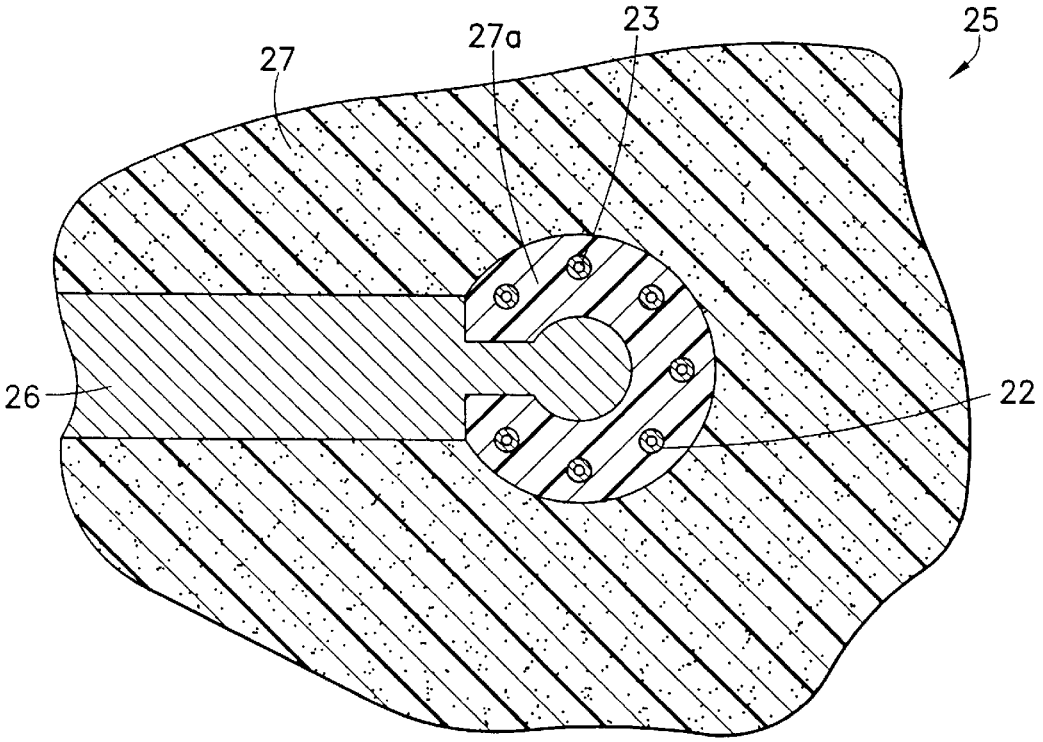
FIG. 3 is a view of the component of FIG. 2 taken along the line 3—3 thereof.

Referring to the assembly 25 of FIGS. 2 and 3, which is a bonded air strip transmission line similar to that of FIG. 1, comprising a center metal conductor strip 26 or trace on a dielectric substrate NM, core layers 27 and 28 and ground plane faceskins 29 and 30, all adhesively-bonded together to form a strong, lightweight integral assembly. Access to the center strip 26 or trace is provided by drilling away a section of the upper faceskin 29 and core layer 27 to expose the strip 26, and inserting and soldering or otherwise conductively bonding a side terminal 31 to said strip 26 at 32 to produce a side launch connection to the center trace.

A dielectric bead or retaining piece 33 is inserted into the bore surrounding the terminal 31, as illustrated, and an outer shroud 34, shown by means of broken lines, may be bonded to the faceskin 29, to complete the side access connector, The shroud 34 is in conductive contact with the conductive plate or via fill 23 lining a bore 22 electrically connecting with the faceskin ground planes 29 and 30 in numerous places. In the illustrated embodiment, the core material 27*a* and 28*a* in the connector areas is a higher density foam than 27 and 28 or is a solid dielectric, to provide increased mechanical support for the connector. However this is optional, and the core foam 27 and 28 may be used throughout. Any commercially-available strip transmission connector may be used to provide the terminal 31, dielectric bead 33 and outer shroud 34.

Figure 4:
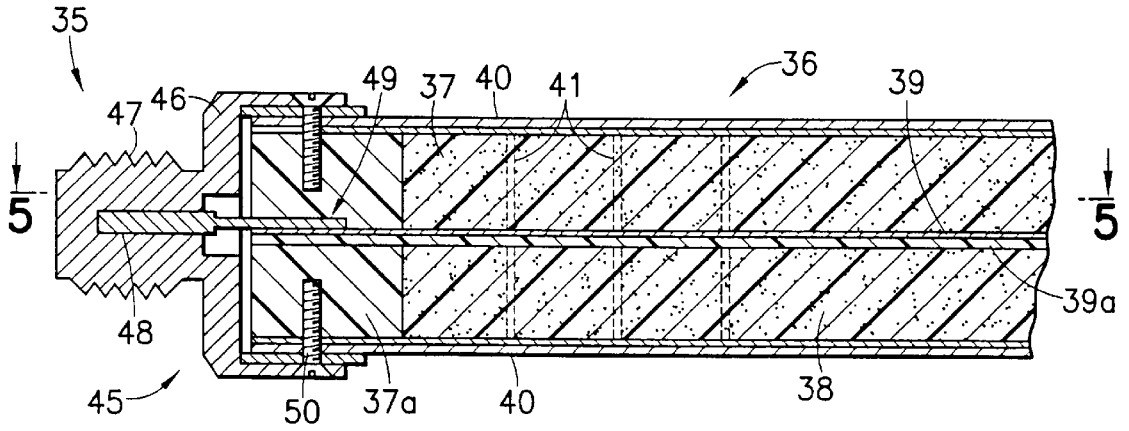
FIG. 4 is a cross-sectional view of a present bonded air strip transmission line assembly implemented with an end launch connector.
Figure 5:
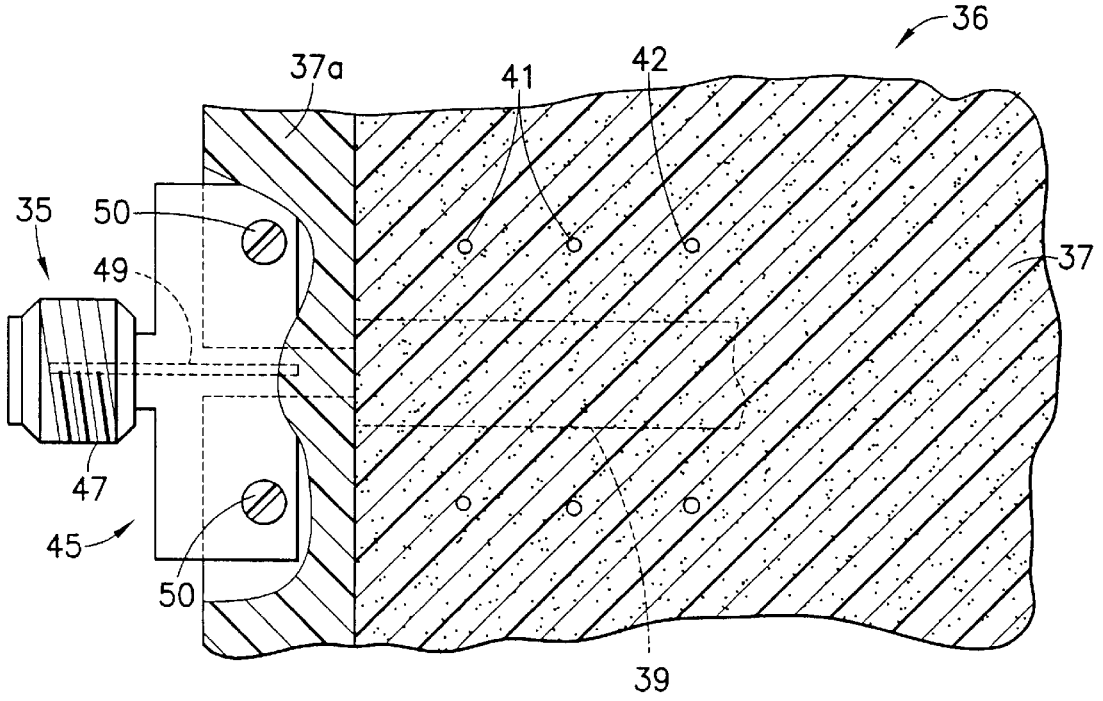
FIG. 5 is a view of the component of FIG. 4 taken along the line 5—5 thereof.

In the embodiment shown in FIGS. 4 and 5 an end launch connector 35 is integrated with and mechanically-fastened to a unitary bonded air strip transmission line assembly 36 according to the present invention. The assembly 36 is similar to that of FIGS. 2 and 3 except that the edge or end to which the conventional strip transmission connector 35 is attached is strengthened or reinforced by the use of higher density foam or by the use of solid dielectric material 37*a*, whereas lower density lightweight plastic foam is used for core layers 37 and 38. The use of higher density foam or solid dielectric material, however, is optional and the core foam 37 and 38 may be used throughout. The STL assembly is similar to that of FIG. 1 in that it comprises a center conductor strip or trace 39 on a thin dielectric board or mechanical support 39*a* bonded between foam core layers 37 and 38 to which are bonded outer faceskin ground planes 40. A plurality of bores or vias 41 are drilled through the assembly, from one ground plane 40 to the other, and each is filled or wall-coated with conductive metal, usually electroless copper, 42. The trace 39, such as copper, is formed by etching the unwanted part from the support 39*a*.

The connector 35 is a commercially-available STL component comprising a metal housing 45 having a U-shaped attachment section 46 and a receptacle section 47 surrounding a terminal 48 which is electrically connected with the center trace 39 by being mechanically pressed or soldered thereto at area 49. The connector housing section 46 is mechanically fastened to the unitary STL component by means of bolts or fasteners 50 through bores drilled through the foam or solid dielectric material 37*a* at the connector end of the STL assembly 36.

Figure 6:
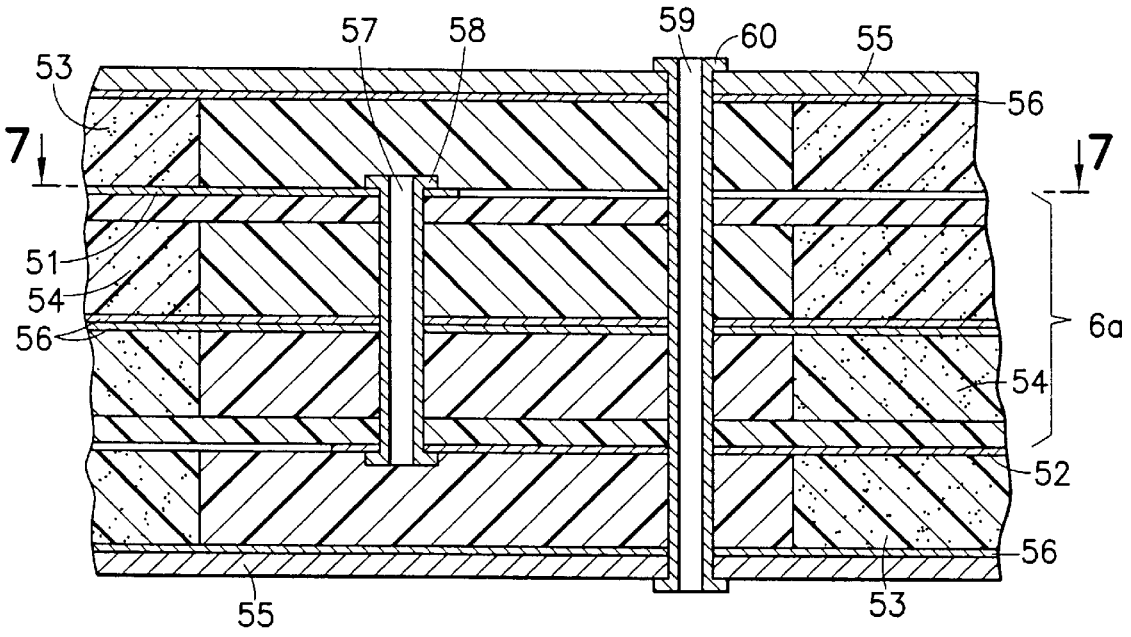
FIG. 6 is a cross-sectional view of an air strip transmission line comprising normally-independent circuits electrically-connected to each other without external connectors or internal solder joints.
Figure 7:
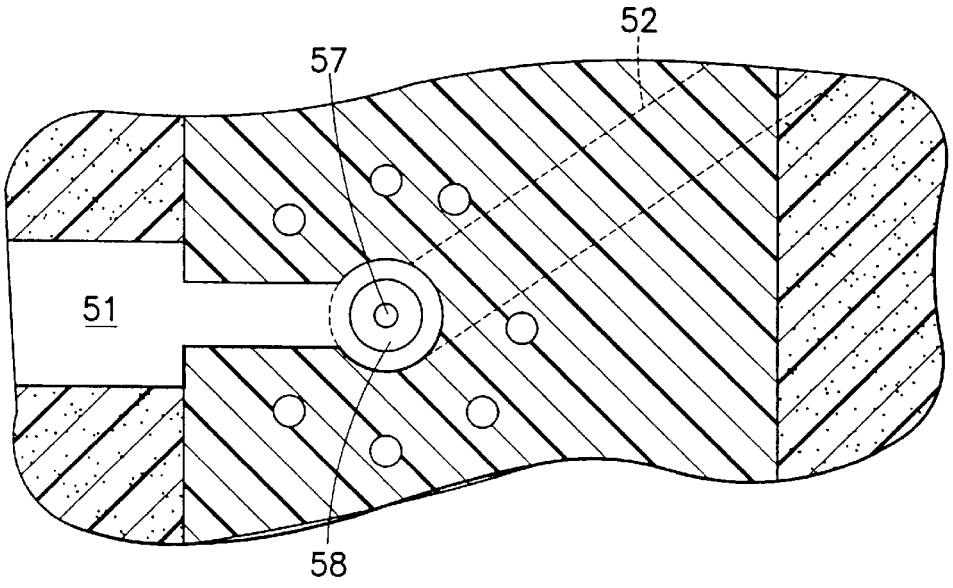
FIG. 7 is a view taken along the line 7—7 of FIG. 6.

FIGS. 6 and 7 illustrate integrations or interconnections between otherwise independent different STL members to form a unitary strong assembly, without the need for conventional connectors.

In the embodiment of FIGS. 6 and 7, a two step bonding process is used to interconnect two separate assemblies without the need for external connectors. Subassembly 6*a* is formed by bonding together the center dielectric layers or circuit boards having metal foil 51 and 52, their respective foam core layers 54 and the central ground planes 56. Two metal ground planes are shown, however, a single plane may be used. The desired circuitry is then formed on metal foil 51 and 52, usually by photo-etching. The subassembly 6*a* is then drilled and plated through hole or via 57 is formed by plating metal, usually electroless copper, to the edges of the via 58, electrically connecting the circuits on 51 and 52 to form a RF via.

The second bonding step is performed by aligning the top and bottom ground planes 55, and the core layers 53 to the subassembly 6*a,* forming an integral package. The last step is to form the parallel plate propagating mode suppression holes or vias by drilling hole(s) 59 through the assembly and plating the edges of the hole(s) with metal 60 to form a mode suppression via.

Figure 8:
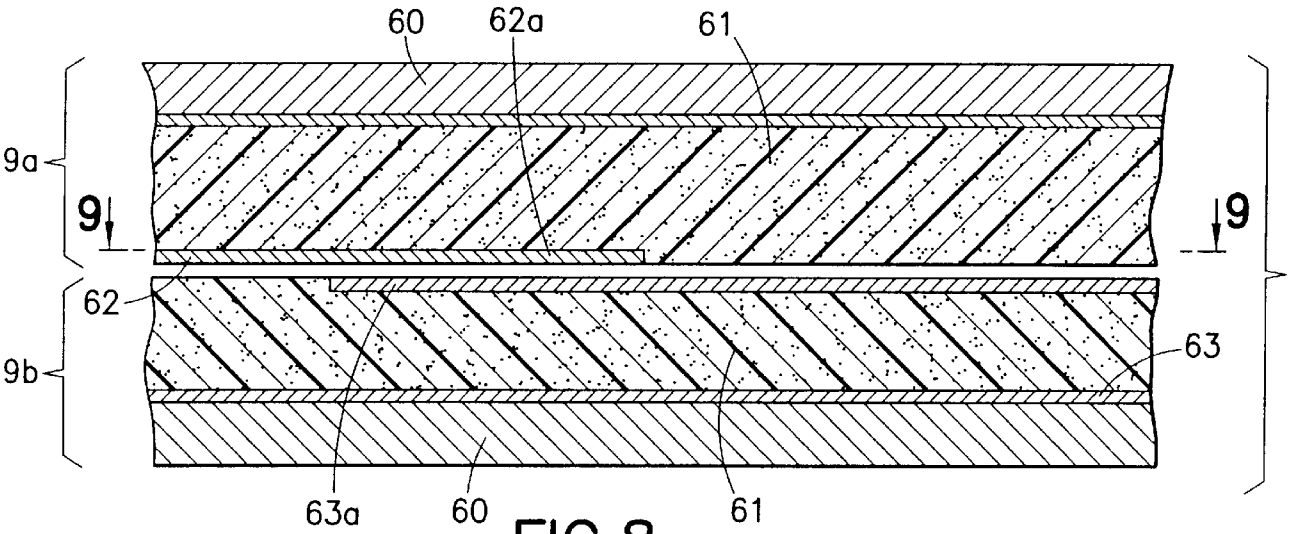
FIG. 8 is a cross-sectional view of an air strip transmission line component incorporating a quarter wavelength overlapping line interconnection according to another embodiment of the invention.
Figure 9:
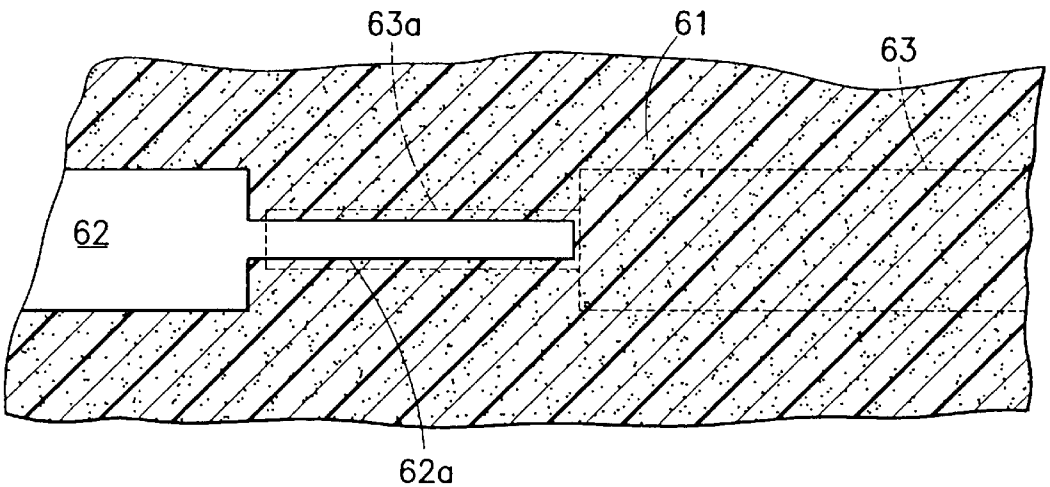
FIG. 9 is a view taken along the line 9—9 of FIG. 8.

In the embodiment of FIGS. 8 and 9 a unitary assembly is produced which incorporates overlapping quarter wavelength center conductors or traces. As illustrated, a first sub-assembly 9*a* and a second sub-assembly 9*b* are independently formed by bonding together a ground plane layer 60, a foam core layer 61 and a circuit layer or trace 62, 63 having a narrow end termination 62*a* and 63*a,* respectively. The sub-assemblies are superimposed with the circuit layers 62 and 63 facing each other and the terminations 62*a* and 63*a* overlapping from different directions, and are adhesively bonded together to form a unitary assembly incorporating a quarter wavelength overlapping line interconnect.

Figure 10:
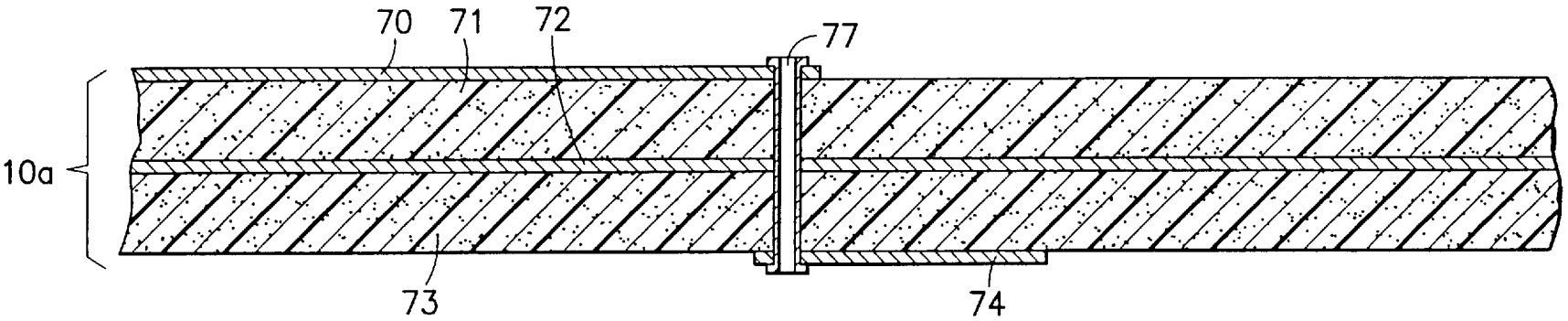
FIGS. 10 and 11 are cross-sectional views of first and second sub-assembly strip transmission line components incorporating a quarter wave line segment, to be united by resinous adhesive to produce a multi-layer assembly.
Figure 11:
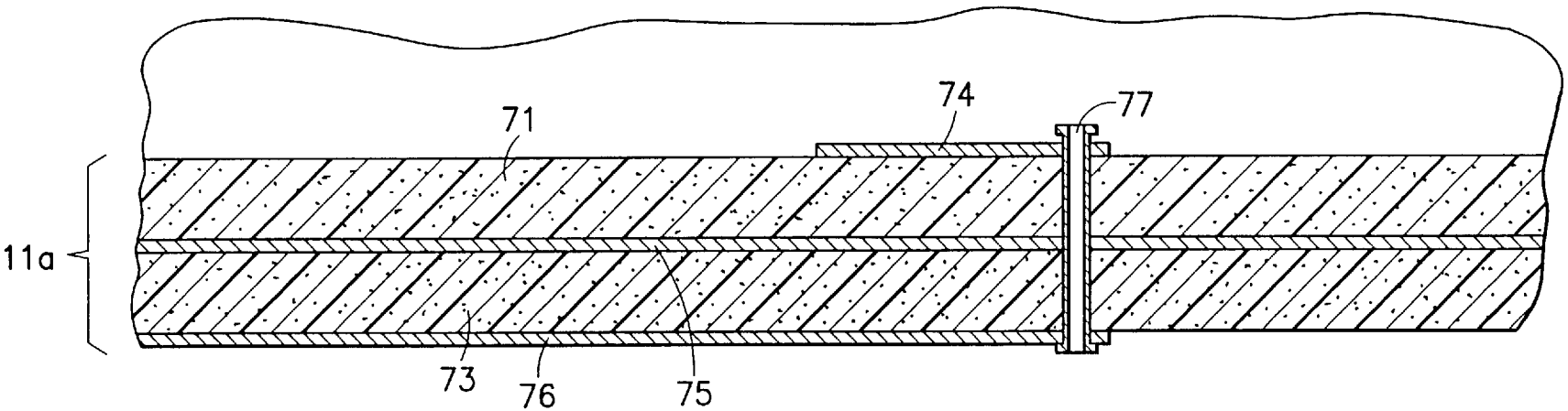

By combining the plated through interconnect and the quarter wavelength overlapping line interconnect shown in FIGS. 8 and 9, and using a multi-step bonding process, any number of assemblies or layers may be combined and bonded to form a single integral, composite structure. This approach produces a mechanically strong, low cost, multilayer assembly with no internal connectors or solder joints for increased reliability in a space-borne environment. FIGS. 10 and 11 present a procedure for using the plated through and quarter wavelength overlapping line interconnect to form a single, integral, composite structure containing, in this example, three otherwise independent assemblies without the use of connectors or solder joints. For simplicity, three assemblies containing three circuit layers and a two step bonding process are illustrated, however, the procedure can be extended to any desired number of circuit layers and bonding steps.

The first step in the two step bonding process is illustrated schematically in FIG. 10. Circuit layer 70, a foam dielectric layer 71, ground plane layer 72, another foam dielectric layer 73 and half of a quarter wavelength overlapping line on layer 74 are bonded together in a single bonding step to form subassembly 10*a*. Similarly, the other part of the quarter wavelength overlapping line on layer 74, two foam substrate layers 71, 73, ground plane layer 75 and circuit layer 76 are bonded together to form subassembly 11*a*. After bonding, circuit layer 70 and 74 on subassembly 10*a* and circuit layers 76 and 74 on subassembly 11*a* are interconnected with plated through holes 77. As shown in the figures circuit layer 74 on subassembly 10*a* contains one half of a quarter wavelength overlapping interconnect and circuit layer 74 on subassembly 11*a* contains the other half.

Figure 12:
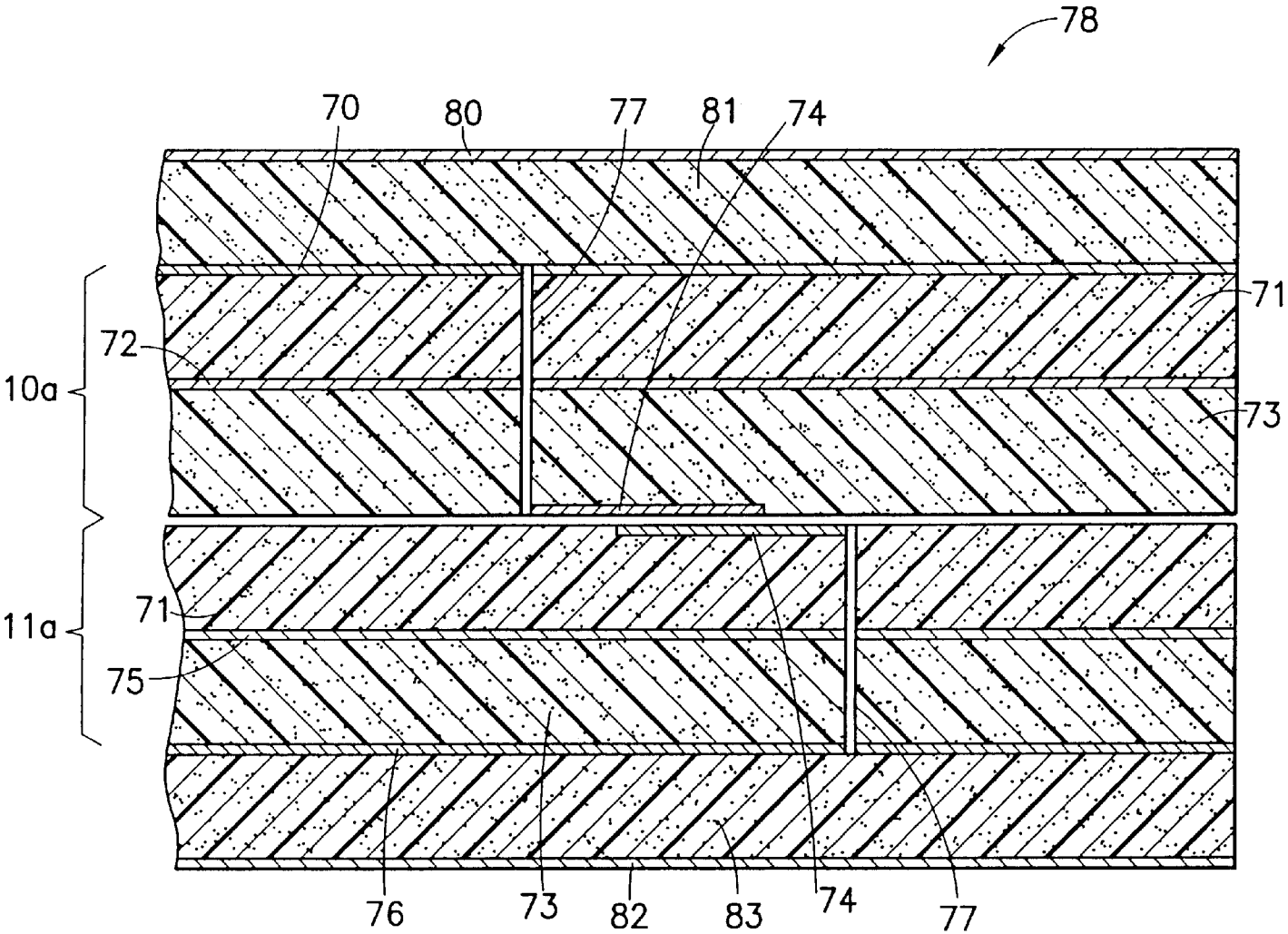
FIG. 12 is a cross-sectional view of a multilayer strip transmission line assembly produced by the bonding together of the sub-assemblies of FIGS. 10 and 11.

The second step in the two step bonding process is illustrated schematically in FIG. 12. Subassembly 10*a* and subassembly 11*a* are properly aligned, separated by a thin layer of bonding film and assembled together. Ground plane 80, a layer of bonding film, a foam dielectric layer 81 and another layer of bonding film are aligned and assembled to circuit layer 70. Ground plane 82, a layer of bonding film, a foam dielectric layer 83 and another layer of bonding film are aligned and assembled to circuit layer 76. The completed assembly is then bonded together under elevated temperature and pressure to form a single, integral composite structure 78.

The present assemblies accommodate all strip transmission line circuits and antennas formed by photo etching any or all of the foil surfaces and include configurations utilizing resistive film between the copper foil and the dielectric substrate.

It will be apparent to those skilled in the art, in the light of the present disclosure that the central conductor strip or trace of the present assemblies can be used to form all of the strip transmission line circuits, usually by photoetching, used in beam forming networks, including resistive elements, and that the center trace or strip can be used to form electromagnetically coupled probe(s), slot(s) or plated through vias to connect to any printed circuit slot or patch type antennas(s) formed into one or both outside ground planes, usually by photoetching.

Also, any printed circuit patch-type antenna(s) can be formed, usually by photoetching, into one or more of the outermost circuit layers with the outermost ground planes omitted. The patch-type antenna(s) can be fed directly from circuitry on the same layer or can be connected to internal circuitry with electromagnetically-coupled probe(s), slot(s) or plated-through vias(s).

This enables plated-through vias and quarter wavelength overlapping line interconnections to electrically interconnect conductor strips on numerous different layers and produce a multi-layer package requiring no other internal or separate connectors or solder joints.

All circuit layers can be extensive and contain any desired strip transmission line circuits. Circuit layer 74 of FIG. 12, for example, can have a long trace length between either or both plated through interconnects 77 and the quarter wavelength overlapping lines.

Multistep drilling and plating will accommodate any required channelization for unwanted parallel plate modes in any or all of the layers including any necessary joining together electrically of configurations using metal foil on the top and bottom of thin substrate material.

To increase the edge strength of the completed assemblies, higher density foam, solid dielectric material or metal can be bonded into the external edges replacing the foam cores.

After final bonding the entire assembly may be edge plated with metal to suppress electromagnetic interferences and intermodulation products while providing a hermetically sealed package.

Side launch connectors can be mounted to the outside ground planes, or with the proper edge extensions of ground planes and center conductor traces, end launch connectors may be used to electrically connect to the assembly.

Any printed circuit slot type antenna element(s) can be etched into one or both outside ground planes and connected to internal circuitry with electromagnetic coupled probe(s) or with a plated through hole(s). Alternately, any printed circuit patch type antenna element(s) can be etched into one or more of the outermost circuit layer(s) with the outermost ground planes omitted. The patches can be fed directly from circuitry on the same layer or connected to internal circuitry with electromagnetic coupling probe(s), slot(s), or plated through holes.

While preferred embodiments of the invention have been disclosed in detail, it should be understood by those skilled in the art that various other modifications may be made to the illustrated embodiments without departing from the scope and spirit of the invention as described in the specification and defined in the appended claims.

What is claimed is:

1. A bonded air strip microwave transmission line assembly for satellite antennas and beamforming networks having low radio frequency energy loss, comprising:

(a) a thin central conductor strip;

(b) an opposed pair of upper and lower solid dielectric core layers of lightweight plastic foam having a low dielectric constant and low radio frequency energy loss adhesively bonded to confine the conductor strip therebetween;

(c) an opposed outer pair of thin conductive faceskins, each adhesively bonded to the outer surface of one of the dielectric core layers;

(d) at least one opening through said conductive faceskins and through the dielectric core layers, and (e) a continuous conductive material which enters the opening to provide conductive contact between the conductive faceskins to suppress parallel plate propagating modes during use.

2. The bonded air strip transmission line assembly according to claim 1 in which at least one said holes or via extends through said central conductor strip, to provide conductive contact between said strip and said conductive faceskins.

3. The bonded air strip transmission line assembly according to claim 1 in which the thin conductor strip comprises a dielectric support or circuit board carrying a said thin conductor strip on one or both surfaces thereof.

4. The bonded air strip transmission line assembly according to claim 3 in which the thin conductor strip or trace comprises beam forming transmission line circuits photoetched on a dielectric circuit board support.

5. The bonded air strip transmission line assembly according to claim 1 in which said core layers comprise areas of low density plastic foam and adjacent areas of high density plastic foam or solid dielectric composition for purposes of strengthening said adjacent areas.

6. The bonded air strip transmission line assembly according to claim 5 in which said adjacent areas are edge areas or other areas to which external connectors are electrically attached to the central conductor strip.

7. The bonded air strip transmission line assembly according to claim 1 in which said thin conductive faceskins comprise a thin metal foil or metal plate on a dielectric support.

8. The bonded air strip transmission line assembly according to claim 1 further comprising at least one side connector means exposed at a surface of said assembly to provide electrical contact with the central conductor strip or trace thereof, said connector means comprising a terminal bonded to said conductor strip and extending outwardly through an opening in a said faceskin and core layer.

9. The bonded air strip transmission line assembly according to claim 1 further comprising at least one end connector means attached to an edge portion of said assembly at which said central conductor strip is accessible, in which said edge portion composed of core layers of higher density plastic foam or of solid dielectric supporting said connector means, and terminal means within said connector means conductively bonded or soldered to said central conductor strip or trace.

10. A bonded air strip transmission line assembly according to claim 1 further comprising probe (s), slot(s) or plated-through vias which are electromagnetically-coupled to printed circuit slot(s) or patch-type antenna(s) circuits formed into one or both outside faceskins forming outer circuit layers which can be fed from circuitry on the same layer or connected internal circuitry by said probe(s), slot(s) or plated vias.

11. A bonded air strip transmission line assembly according to claim 1 in which said continuous conductive material enters said opening and coats said opening.

12. A bonded air strip transmission line assembly according to claim 1 in which said continuous conductive material enters said opening and fills said opening.

13. Method for producing a strong, lightweight air strip transmission line assembly having low radio frequency energy loss, comprising the steps of adhesively bonding a thin central conductor strip between an opposed pair of dielectric core layers of lightweight plastic foam having a low dielectric constant and low radio frequency energy loss to confine the conductor strip there between; adhesively-bonding a thin conductive faceskin to the outer surfaces of each of the core layers; boring at least one opening through the faceskins and core layers; and introducing a metal into each opening to form a continuous coating on the wall thereof and provide an electrical connection between the conductive faceskins.

14. Method according to claim 13 in which said holes or vias are also bored through said central conductor strip or trace to provide conductive contact between said strip or trace and said conductive faceskin.

15. Method according to claim 13 in which the thin conductor strip comprises a thin dielectric support or circuit board carrying a said thin conductor strip on one or both surfaces thereof.

16. Method according to claim 15 which comprises forming on said dielectric support or circuit board a thin conductor strip comprising at least one beam-forming circuit.

17. Method according to claim 13 in which said core layers comprise areas of low density plastic foam and adjacent areas of high density plastic foam or solid dielectric composition for purposes of strengthening said adjacent areas.

18. Method according to claim 17 which comprise attaching solid adjacent edge areas or other areas to which external connectors are attached in electrical connection with the central conductor strip.

19. Method according to claim 13 in which said thin conductive faceskins comprise a metal plate or a thin metal foil on a dielectric support.

20. Method according to claim 13 further comprising attaching at least one side connector means exposed at a surface of said assembly to provide electrical connection with the central conductor strip thereof, said side connector means comprising a terminal conductively bonded or soldered to said conductor strip and extending outwardly through an opening in a said faceskins and core layer.

21. Method according to claim 13 further comprising attaching at least one end connector means to an edge portion of said assembly at which said central conductor strip is accessable, said edge portion comprising core layers of higher density plastic foam or of solid dielectric supporting said end connector means, and conductively bonding or soldering terminal means within said connector means to said central conductor strip.

22. Method according to claim 13 which comprises forming printed circuit slot(s) or patch-type antenna circuit(s) into one or both outside faceskins, and electromagnetically-coupling said printed circuit slot(s) of antenna circuit(s) by means of probe(s), slot(s) or plated through vias to form outer circuit layers which can be fed from circuitry on the same layer or from internal circuitry.

* * * * *